US005908221A

United States Patent [19]

Neil

[11] Patent Number: 5,908,221

[45] Date of Patent: Jun. 1, 1999

[54] VERTICALLY ADJUSTABLE ARMREST ASSEMBLY FOR A CHAIR

[75] Inventor: Gary K. Neil, Mississauga, Canada

[73] Assignee: Allseating Corporation, Mississauga, Canada

[21] Appl. No.: 09/092,866

[22] Filed: Jun. 8, 1998

Related U.S. Application Data

[ 60] Provisional application No. 60/049,089, Jun. 9, 1997.

[51] Int. Cl.[6] ..... A47C 7/54

[52] U.S. Cl. ..... 297/411.36; 297/411.37

[58] Field of Search ..... 297/411.35, 411.31, 297/411.3, 411.36, 411.37, 116; 248/125.7, 125.9, 157, 118, 118.3

[56] References Cited

U.S. PATENT DOCUMENTS 3,829,159 8/1974 Leffler .
3,950,027 4/1976 Wilson .
4,934,723 6/1990 Dysarz .
5,393,124 2/1995 Neil .
5,395,160 3/1995 Krebs et al. .
5,536,070 7/1996 Lemmen .
5,636,899 6/1997 Schiff et al. .
5,795,026 8/1998 Dral et al. .

*Primary Examiner*—Milton Nelson, Jr.
*Attorney, Agent, or Firm*—Eugene J. A. Gierczak

[57] ABSTRACT

A vertically adjustable armrest assembly for a chair having a hydraulic actuator that allows the upper arm of the chair to be raised to a multiple of positions by engaging the hydraulic actuator with a lever located on the underside of the upper arm. The upper arm may also rotate about a horizontal axis allowing the user to orient the upper arm to the most comfortable position for keyboarding.

20 Claims, 6 Drawing Sheets

VERTICALLY ADJUSTABLE ARMREST ASSEMBLY FOR A CHAIR

This application claims benefit of provisional application 60/049,089 filed Jun. 9, 1997.

FIELD OF INVENTION

This invention relates generally to a vertically adjustable armrest assembly for a chair and more particularly to an armrest assembly for a chair that comprises of an armrest and a hydraulic means which is vertically moveable to a multitude of positions. The armrest assembly allows the user to customize the position of the armrest in a vertical position using a hydraulic means thereby allowing the user to easily move the armrest assembly to a variety of positions without exerting a great deal of effort. Furthermore the armrest assembly can be pivotally adjusted in the horizontal plane thereby providing the user with additional support to the arms, forearms, wrists and shoulders in order to alleviate repetitive stress injuries when the user is keyboarding or involved in other keying or similar activities while sitting in a chair equipped with the armrest assembly.

BACKGROUND OF THE INVENTION

Various chairs and armrest assemblies have been designed to support a user's forearm and wrist and can be adjusted vertically. However many of these supports only allow for limited movement of the armrest and requires a great deal of pressure to adjust vertically.

For example, U.S. Pat. No. 4,270,798 issued on Jun. 2, 1991 to Coach & Car Equipment Corporation, discloses an armrest which is pivotable through a vertical plane between a horizontally extending, arm-supporting position and an upwardly extending position alongside the seat back. The armrest is also pivotable, in response to a predetermined outwardly directed force against the armrest, through a horizontal plane, between the above-described arm-supporting position and a position in which the armrest extends rearwardly from the seat back.

U.S. Pat. No. 4,429,918 which issued on Feb. 7, 1984 to Syntex (U.S.A.) Inc. relates to an operatory stool.

U.S. Pat. No. 4,438,975 issued to Dentsply Research & Development Corp. on Mar. 27, 1984 relates to a post relatively fixed with respect to seat 16, unless vertical adjustment is desired by means of the hand screw.

U.S. Pat. No. 5,382,079 was issued on Jan. 17, 1995 to Chromcraft Revington, Inc. relates to the adjustable arm including an arm body having an upper housing and a sleeve portion which is slidably mounted on the generally vertical section of the arm frame assembly for vertical adjustment of the chair arm. A latching assembly is connected to the frame assembly and arm body for releasably locking the arm body in a plurality of vertical positions on the frame assembly. Lastly, an actuator, integral with the latching assembly, is provided for disabling the latching assembly.

U.S. Pat. No. 5,393,124 issued to Gary K. Neil on Feb. 28, 1995 relates to an armrest assembly for a chair comprising, an upper arm, support shaft structure associated with the upper arm, the support shaft presenting an axis of rotation for rotational movement of the upper arm, a structure associated with the chair for receiving the support shaft for relative rotational movement of the upper arm relative the receiving structure about the axis, and a structure for radially rotating the position of the upper arm about the axis of rotation to multiple positions as required for the user's comfort.

U.S. Pat. No. 4,907,835 issued on Mar. 13, 1990 to Charles Salter relates to a removable arm rest apparatus for use in a truck cab utilizing an upright tubing structure and a flat arm support member projecting normally outward therefrom.

U.S. Pat. No. 4,917,438 issued on Apr. 17, 1990 to Flight Equipment & Engineering Limited relates to an adjustable-width seating for passenger-carrying vehicles.

U.S. Pat. No. 5,439,267 issued on Aug. 8, 1995 to Steelcase Inc. relates to a chair including a tubular arm support, an armrest, a lateral adjustment mechanism and a vertical height adjustment mechanism. The lateral adjustment mechanism includes a plurality of nested slides. One slide is connected to the vertical height adjustment mechanism. An uppermost slide supports the arm rest. The slides are adjustable laterally with respect to each other to position the armrest with respect to the chair. The vertical height adjustment mechanism includes a tubular liner insertable into the arm support. The liner defines a bore and a plurality of vertically spaced notches or grooves. A latch tube telescopes with the bore of the liner. An upper end of the latch tube is connected to the lateral adjustment mechanism. The latch is pivotally positioned within the latch tube. The latch includes a latch end moveable into and out of engagement with the notches. An actuator engages the latch to move it between locked and unlocked positions.

U.S. Pat. No. 3,339,873 issued on Sep. 5, 1967 to D. H. Hale relates to a stool with a vertically moveable seat wherein a tank disposed under the seat at the top of a hollow reciprocable piston rod and containing air under pressure to accommodate, upon opening a valve between the hollow interior of the piston rod and the interior of the surrounding cylinder by actuation of a plate under the seat above the tank, (a) elevation of the piston rod, the actuating table, the seat and the tank, when the seat is not occupied, by a flow of fluid from the interior of the piston rod through and around a disc flow control into the interior of the cylinder under force of said pressure, and (b) lowering of the piston rod, the actuating plate, the seat and the tank, when the seat is occupied, by flow of fluid from the interior of the cylinder through the disc flow control to the hollow interior of the piston rod counter to said pressure.

U.S. Pat. No. 3,547,394 issued on Dec. 15, 1970, to Cramer Industries, Inc. relates to vertically adjustable articles of furniture and more particularly to an apparatus for adjusting the height of a chair seat.

U.S. Pat. No. 3,711,054 issued to Fritz Bauer on Jan. 16, 1973 relates to a lifting device for the stepless height adjustment of the seat surface member of a chair, stool or the like.

U.S. Pat. No. 4,940,202 issued on Jul. 10, 1990 to Stabilus GmbH relates to a stepless adjustable vertical movement device for chairs, tables or the like articles, which comprises a blockable gas spring which is arranged in a telescopic unit consisting of a telescopic tube and a guide tube and is connected by means of a self-locking taper connection on the one hand with the chair seat or a similar article of adjustable height and on the other hand with a foot part, a simple replacement of the gas spring is to be provided, with security against unintended unscrewing of the gas spring is guaranteed.

U.S. Pat. No. 4,940,202 issued on Nov. 13, 1990 to Suspa Compart Aktiengesellschaft relates to an adjustable-length column for chairs, tables or the like having an upright tube and a gas spring disposed in it. The piston rod of the gas spring is supported against a bottom plate of the upright tube. To assure support of the bottom plate in the face of extremely strong forces in the axial direction of the column at little manufacturing expense, the rim of the upright tube is bent inward approximately semicircularly in cross section. The bottom plate is supported on the end face of the rim.

Each of the prior art devices referred to above present relatively complicated structures having relatively limited mobility of the armrest. Large forces are also required to activate the adjustable-length columns that are located in the seat portions of many of the prior art devices. An advantage to the present invention is the ease in which the armrest assembly can be manufactured, assembled and repaired due to the lack of complexity of the structures. Another advantage is that the amount of pressure that is required to activate the armrest assembly is dramatically reduced, thereby requiring the user to exert only a minimal force for the armrest to be activated.

SUMMARY OF INVENTION

It is an object of this invention to produce an improved armrest assembly which can be adjusted vertically to multiple positions, allowing the user to customize the height position of the armrest to provide added comfort. The armrest assembly may also pivot through a horizontal plane allowing the user to adjust the armrest to multiple positions to provide additional support to the user's forearm. Other objects of the invention will appear hereinafter.

The broadest aspect of this invention relates to a vertically adjustable armrest assembly for a chair comprising, an upper arm, a lower support means, the lower support means associated with the upper arm when the upper arm in a closed position, a hydraulic means associated with the upper arm for vertical movement of the upper arm, the hydraulic means presenting an axis of rotation for rotational movement of the upper arm about a horizontal plane, a housing means associated with the chair for receiving the hydraulic means for relative rotational movement of the upper arm about the axis and the upper arm, and a lever means associated with the upper arm and the hydraulic means enabling the user to vertically adjust the upper arm into multiple positions as required for the user's comfort.

It is another aspect of this invention to provide a vertically adjustable armrest assembly wherein the lever means further comprises of a first portion and a second portion, the first portion being associated with the second portion with an attachment means, the second portion engaging the hydraulic means when the user engages the lever means, a locating member having a stopping means and a spring located between the first portion and the upper arm thereby providing resistance when the user engages and releases the upper portion of the lever means.

In accordance with a further aspect of the invention, there is provided a vertically adjustable armrest assembly for a chair wherein the hydraulic means is fictionally secured into the housing. The housing may have a collar to receive a removable retaining means that allows the hydraulic means to be removed from the housing.

BEST MODE FOR CARRYING OUT THE INVENTION

Figure 1:
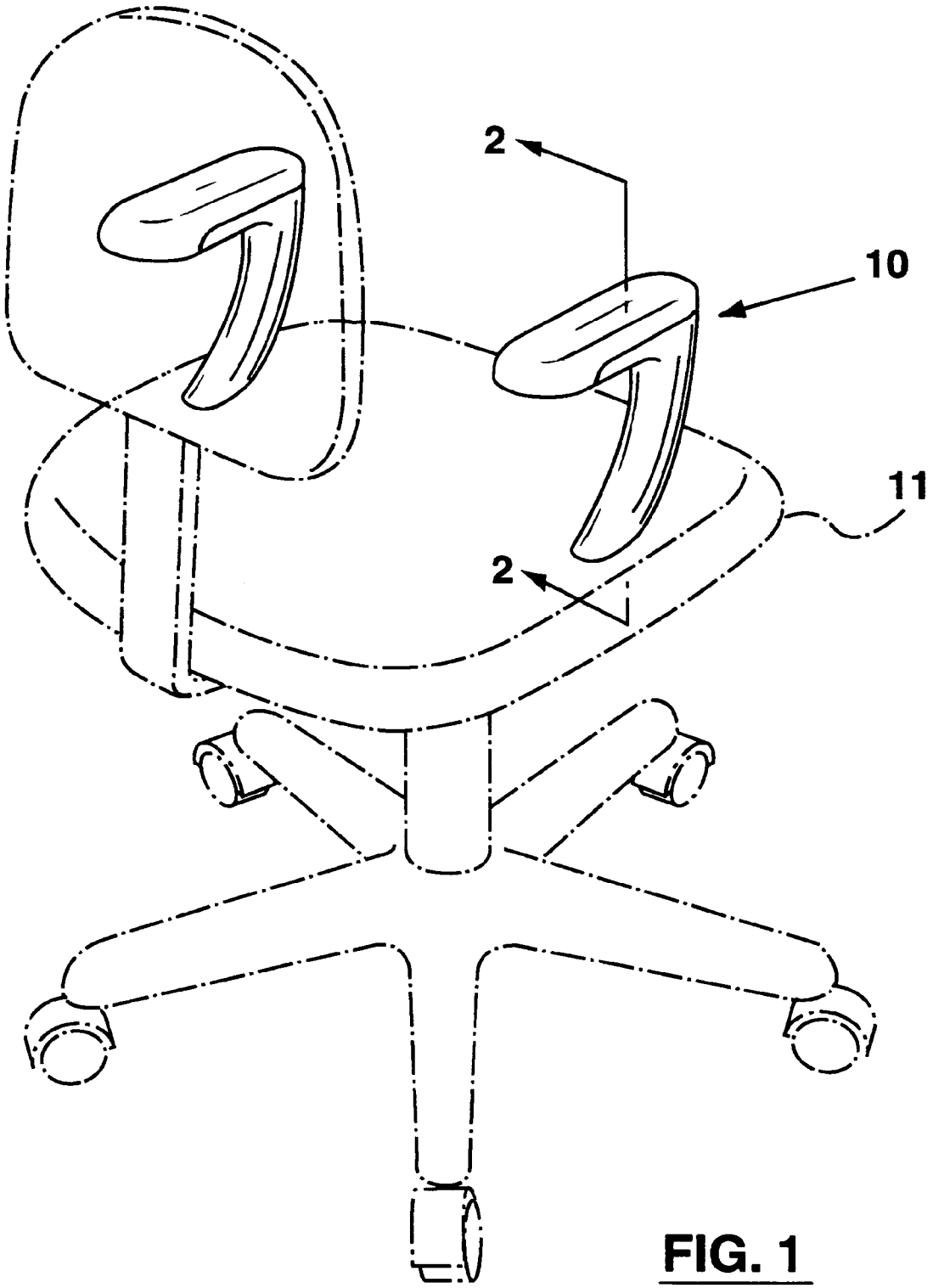
FIG. 1 is a perspective view of a vertically adjustable armrest assembly for a chair, in accordance with the preferred embodiment of the present invention.

In the description which follows, like parts are marked throughout the specification and the drawings with the same respective reference numerals. The drawings are not necessarily to scale and in some instances proportions may have been exaggerated in order to more clearly depict certain features of the invention.

Figure 2:
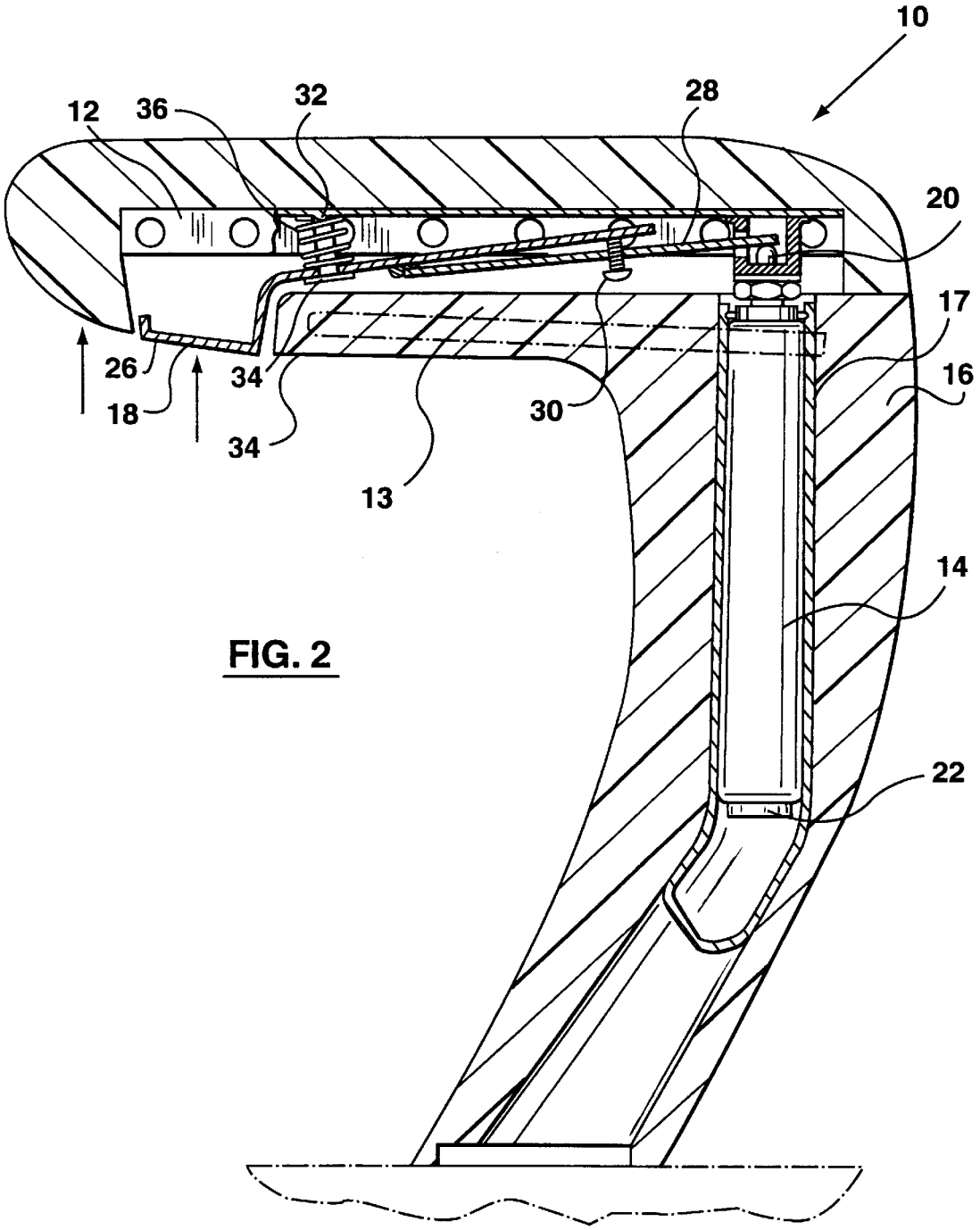
FIG. 2 is a side cross-sectional view along line 2—2 of the preferred embodiment of the present invention as illustrated in FIG. 1.
Figure 3:
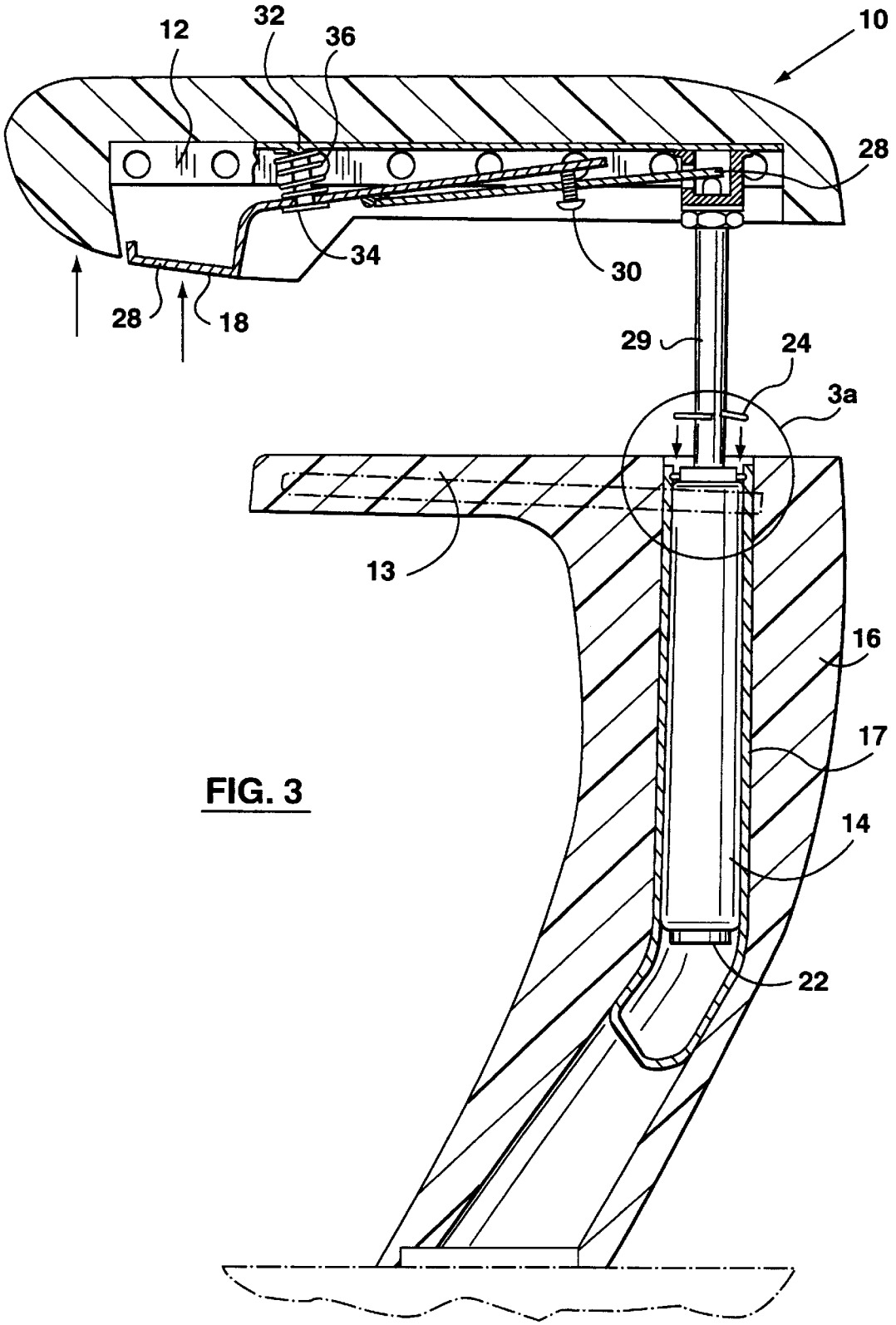
FIG. 3 is a side cross-sectional view of the preferred embodiment of the present invention as illustrated in FIG. 1 in an elevated position.

Referring to FIGS. 1–3 there is illustrated vertical adjustable armrest assembly for a chair 10 in accordance with a preferred embodiment of the present invention. The vertical adjustable armrest assembly for a chair 10 includes, an upper arm 12, a lower support means 13 associated with the upper arm 12, a hydraulic means 14 connected to the upper arm 12 for vertical movement of the upper arm 12, a housing means 16 for enclosing the vertically adjustable armrest assembly 10, the housing means 16 having a collar 17, and a lever means 18 associated with the hydraulic means 14 for adjusting the armrest assembly 10 in a vertical plane.

Figure 3A:
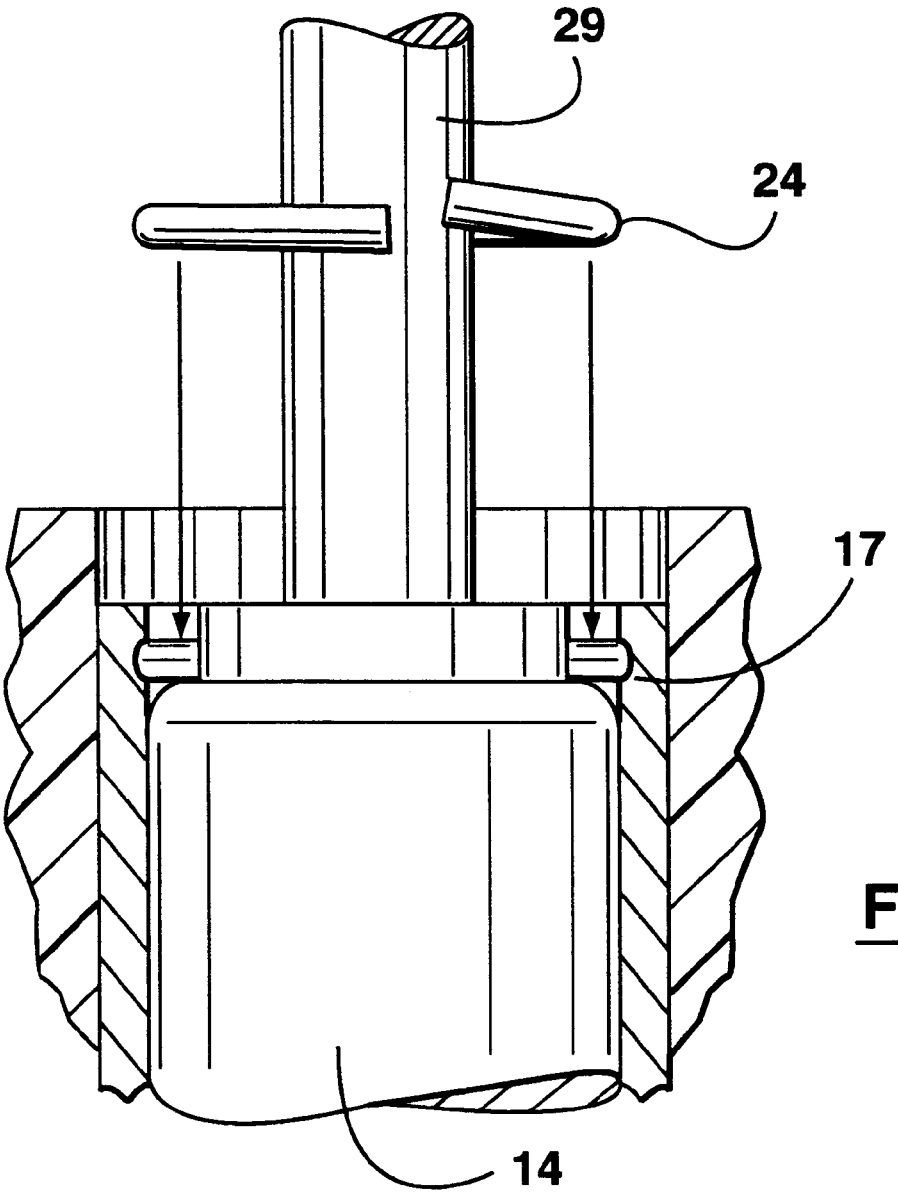
FIG. 3*a* is a side cross-sectional view of the preferred embodiment of the present invention as illustrated in FIG. 1.
Figure 4:
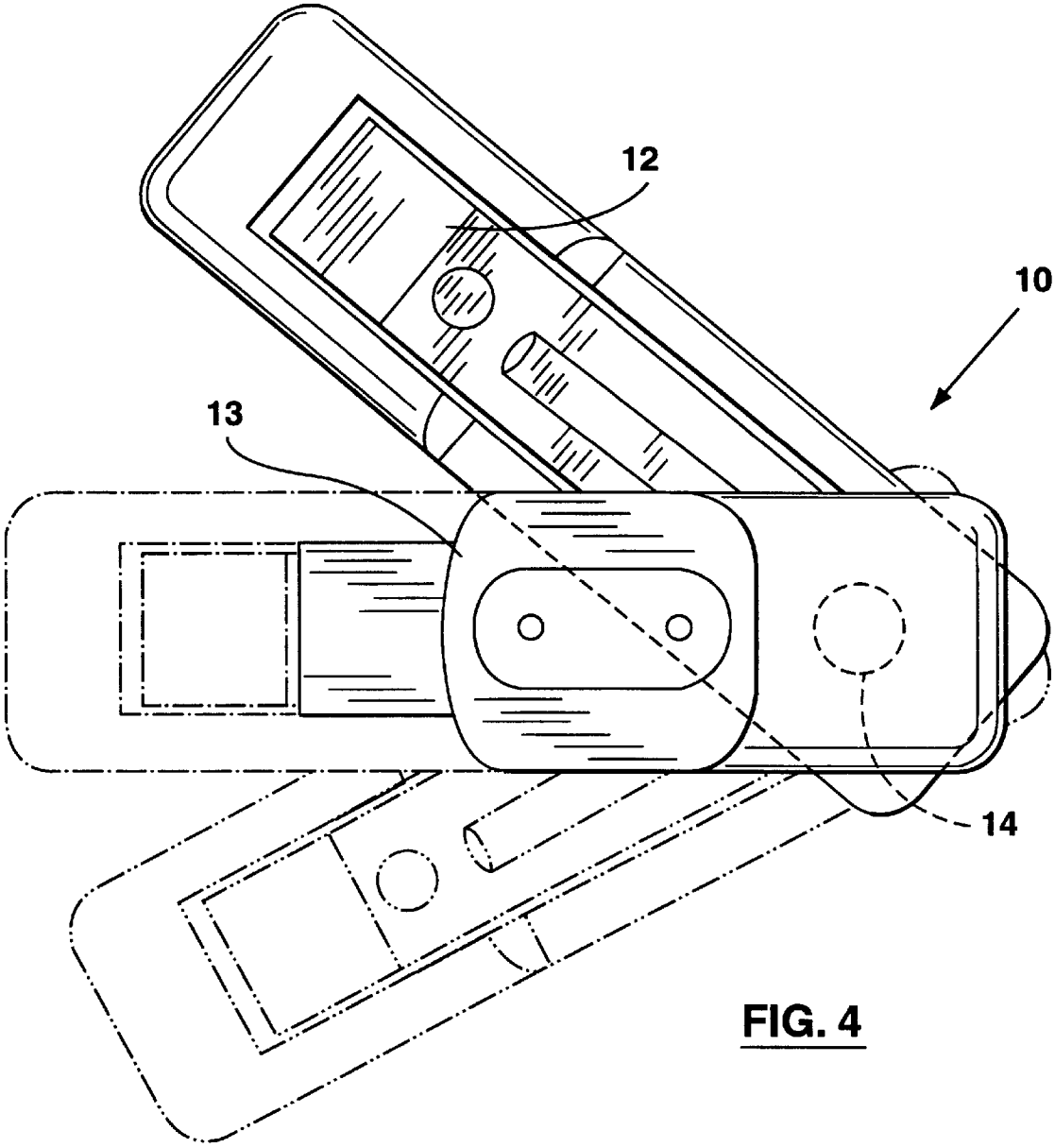
FIG. 4 is a bottom view of the preferred embodiment of the present invention as illustrated in FIG. 1.
Figure 5:
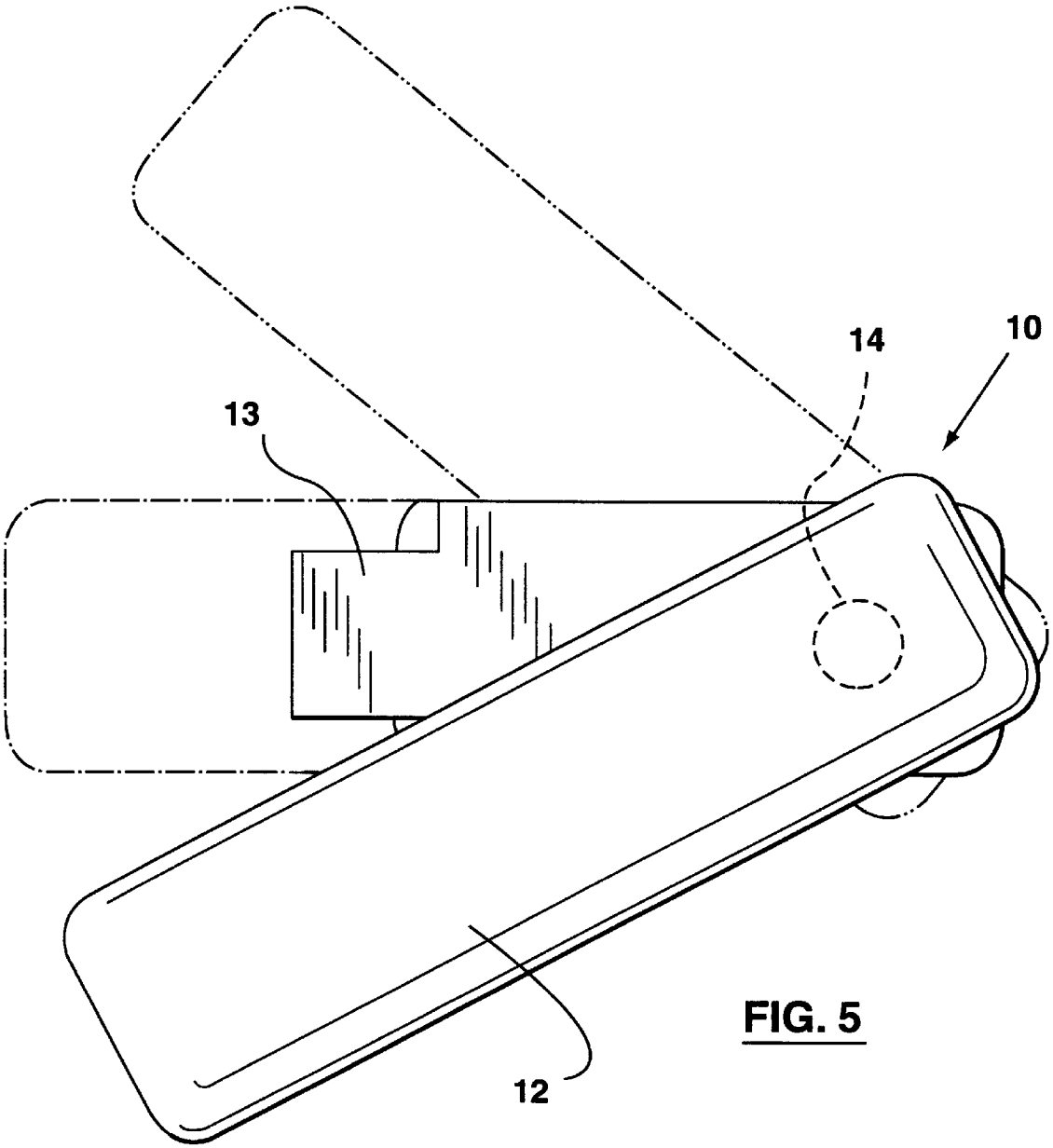
FIG. 5 is a top view of the preferred embodiment of the present invention as illustrated in FIG. 1.

Referring to FIGS. 4 and 5, the hydraulic means 14 has an axis of rotation for rotational movement of the upper arm 12 about a horizontal plane thereby allowing the user to adjust the upper arm 12 to a multitude of rotated positions. The lower support means 13 remains stationary relative to the rotational movement of the upper arm 12 and supports the upper arm 12 when the armrest assembly 10 is in a closed position as shown in FIG. 1. The hydraulic means 14 includes a top end 20 or activation end and a bottom end 22. Referring to FIGS. 3 and 3*a,* the bottom end 22 of the hydraulic means 14 is adapted to be inserted into the collar 17 and may be frictionally engaged therein. A removable retaining means 24, which in one embodiment comprises a compression "C" ring which snaps into the groove of collar 17 as shown in FIG. 3*a.* This allows the user to remove the hydraulic means 14 from the housing 16 when required. The top end 20 of the hydraulic means 14 contacts the lever means 18 when the user engages the armrest assembly 10.

The lever means 18 includes a first portion 26 and a second portion 28, the first portion 26 being associated with the second portion 28 with an adjustment means 30. The adjustment means 30 allows the fulcrum point of the lever means 18 to be adjusted according the user's requirements. The second portion 28 contacts the hydraulic means 14 when the user engages the lever means 18. A locating member 32 is positioned between the first portion 26 and the upper arm 12, and further comprises a stopping means 34 and a spring 36. The lever means 18 is engaged by applying an activation pressure between 0 to 60 Newton, (though a range of 20–40 Newton is preferred), to the first portion 24 thereby compressing the spring 36. The combination of the spring 36 and the stopping means 34 provides resistance when the user engages and releases the first portion 26 of the lever means 18.

In operation the user may apply pressure to the first portion 26 of the lever means 18, thereby causing the second portion 28 of the lever means 18 to contact the top end 20 of the hydraulic means 14. The spring 36 is compressed by first portion 18, thereby providing some resistance to the pressure being applied. By applying the activation pressure in the range of 20 to 40 Newton to the first portion 26, the user engages the hydraulic means 14, causing the armrest assembly 10 to move vertically, either upwardly or downwardly. Once the user has obtained the desired position for the vertical height of the armrest assembly 10, the user ceases to apply pressure to the first portion 26 of the lever means 18, and the first portion 26 comes to rest against the stopping means 34. Once the pressure is relieved, the second portion 28 no longer contacts the top end 20 of the hydraulic means 14, and the hydraulic means 14 is deactivated and the upper arm 12 remains in the fixed position. The hydraulic means 14 can also rotate in the horizontal plane to allow the user to move the arm in various positions to assist the user when keyboarding.

The height of the upper arm 12 can be easily adapted relative the lower support means 13 since the length of the shaft 29 is continually incrementally adjusted form the height shown in the one position in FIG. 3 to the collapsed position shown in FIG. 2. This provides the user with the ability of selecting the appropriate height of the upper arm 12. Since the hydraulic means 14 is activated by such little pressure, the height of the upper arm 12 can be easily adjusted. Furthermore the upper arm 12 can be rotated to a convenient position as shown in FIG. 5.

Various embodiments of the invention have now been described in detail. Since changes in and/or additions to the above-described best mode may be made without departing from the nature, spirit or scope of the invention, the invention is not to be limited to said details.

I claim:

1. A vertically adjustable armrest assembly for a chair comprising:

(a) an upper arm;

(b) a lower support means;

(c) a hydraulic means having an axis of rotation;

(d) a housing means; and (e) a lever means;

wherein said lower support means is associated with said upper arm in a first resting position; said hydraulic means is associated with said upper arm allowing for the vertical movement of said upper arm and rotational movement of said upper arm about said axis in a horizontal plane; said housing means and said lever means associated with said hydraulic means allowing for vertical movement of said upper arm and rotational movement of said upper arm about said axis in a horizontal plane in a second engaged position.

2. A vertically adjustable armrest assembly for a chair as claimed in claim 1 wherein said housing means further comprises a collar for association with said hydraulic means.

3. A vertically adjustable armrest assembly for a chair as claimed in claim 2 wherein said hydraulic means defines a top end and a bottom end.

4. A vertically adjustable armrest assembly for a chair as claimed in claim 3 wherein said hydraulic means defines a shaft which can be adjusted to multiple positions by engaging said lever means.

5. A vertically adjustable armrest assembly for a chair as claimed in claim 3 wherein said bottom end of said hydraulic means is friction fit into said collar of said housing means.

6. A vertically adjustable armrest assembly for a chair as claimed in claim 5 wherein said top end of said hydraulic means associates with said lever means when said armrest assembly is in said second engaged position.

7. A vertically adjustable armrest assembly for a chair as claimed in claim 5 wherein said collar defines a removable retaining means.

8. A vertically adjustable armrest assembly for a chair as claimed in claim 7 wherein said removable retaining means defines a compression "C" ring for removably engaging said collar.

9. A vertically adjustable armrest assembly for a chair as claimed in claim 3 wherein said lever means defines a first portion and a second portion.

10. A vertically adjustable armrest assembly for a chair as claimed in claim 9 wherein said first portion is associated with said second portion by an adjusting means.

11. A vertically adjustable armrest assembly for a chair as claimed in claim 10 wherein said second portion of said lever means contacts said top end of said hydraulic means in said second engaged position.

12. A vertically adjustable armrest assembly for a chair as claimed in claim 11 further comprising a locating member positioned between said first portion of said lever means and said upper arm.

13. A vertically adjustable armrest assembly for a chair as claimed in claim 12 wherein said locating member defines a stopping means and a spring.

14. A vertically adjustable armrest assembly for a chair as claimed in claim 13 wherein said lever means is engaged by an activation pressure in a range up to 60 Newton.

15. A vertically adjustable armrest assembly for a chair as claimed in claim 14 wherein said spring and said stopping means provides resistance to said first portion of said lever means.

16. A vertically adjustable armrest assembly for a chair as claimed in claim 14 wherein said activation pressure is in a range of 20 to 40 Newton.

17. A vertically adjustable armrest assembly for a chair comprising:

(a) an upper arm;

(b) a lower support means;

(c) a hydraulic means having a bottom end, a top end and an axis of rotation;

(d) a housing means having a collar; and (e) a lever means having a first portion and a second portion;

wherein said lower support means is associated with said upper arm in a first resting position; said hydraulic means is associated with said upper arm such that said top end of said hydraulic means engages said lever means when said armrest assembly is in a second engaged position for the vertical movement of said upper arm and rotational movement of said upper arm about said axis in a horizontal plane; said bottom end of said hydraulic means friction fit into said collar of said housing.

18. A vertically adjustable armrest assembly for a chair as claimed in claim 17 wherein said first portion and said second portion of said lever means are associated with one another by an adjusting means.

19. A vertically adjustable armrest assembly for a chair as claimed in claim 18 further comprising a locating member having a spring and a stopping means positioned between said first portion of said lever means and said upper arm.

20. A vertically adjustable armrest assembly for a chair as claimed in claim 19 wherein said lever means is engaged by an activation pressure in a range up to 60 Newton.

* * * * *